US006504517B1

(12) United States Patent
Liu et al.

(10) Patent No.: US 6,504,517 B1
(45) Date of Patent: Jan. 7, 2003

(54) VARIABLE SECTORIZATION TOWER TOP APPLIQUE FOR BASE STATIONS

(75) Inventors: Shang-Chieh Liu, Hsin Chu (TW); Max Aaron Solondz, Morris Township, Morris County, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/659,877

(22) Filed: Sep. 12, 2000

(51) Int. Cl.[7] ..... H01Q 1/12
(52) U.S. Cl. ..... 343/890; 343/853; 343/893
(58) Field of Search ..... 343/850, 853, 343/890, 700 MS, 725, 757, 778, 893; 455/130, 311, 376.1, 277.1, 277.2, 562; 341/110, 111, 117; 375/267, 299, 347; H01Q 1/12

(56) References Cited

U.S. PATENT DOCUMENTS 4,414,550 A * 11/1983 Tresselt ..... 343/700 MS
4,918,458 A * 4/1990 Brunner et al. ..... 343/795
4,962,383 A * 10/1990 Tresselt ..... 343/700 MS
5,327,147 A * 7/1994 Caille et al. ..... 343/700 MS
5,552,798 A * 9/1996 Dietrich et al. ..... 343/893
5,581,583 A * 12/1996 Conti et al. ..... 375/347
5,694,498 A * 12/1997 Manasson et al. ..... 385/15
5,841,388 A * 11/1998 Yasuda et al. ..... 341/155
6,088,003 A * 7/2000 Bassirat ..... 343/890
6,100,827 A * 8/2000 Boesch et al. ..... 341/118
6,181,955 B1 * 1/2001 Dartois ..... 455/562
6,321,082 B1 * 11/2001 Katz ..... 455/422

* cited by examiner

*Primary Examiner*—Don Wong
*Assistant Examiner*—Trinh Vo Dinh
(74) *Attorney, Agent, or Firm*—Jimmy Goo; Harness, Dickey & Pierce, PLC

(57) ABSTRACT

An apparatus and method of adaptive sectorization that is amiable to CDMA environments using an antenna configuration and a phase shifter network that can form a variable width beam over which a pilot signal and other downlink signals may be transmitted. The antenna configuration having at least an antenna sub-array with two or more antenna elements. The phase shifter network having a plurality of switches for adjusting beam width by directing signals to be transmitted over one or more of the antenna elements, and phase shifters for shifting phases of the signals to be transmitted over the one or more antenna elements.

26 Claims, 7 Drawing Sheets

10

36

60

VARIABLE SECTORIZATION TOWER TOP APPLIQUE FOR BASE STATIONS

FIELD OF THE INVENTION

The present invention relates generally to wireless communication systems and, in particular. to antenna arrays used in wireless communication systems.

BACKGROUND OF THE RELATED ART

Sectorization of cells is a well-known technique for reusing logical channels in order to enhance the capacity of wireless communication systems. FIG. 1 depicts a conventional sectorized cell 10 in accordance with the prior art. Cell 10 includes three 120° sectors A, B, C, and has an associated base station 12 for providing wireless communication services to mobile-telephones within cell 10. Base station 12 includes, for each sector, a set of base station radios 13, converters 15, and an antenna configuration 14 comprising of two antenna elements 16-1, 16-2. The set of base station radios 13 performs digital base-band signal processing and provides wireless communication services to mobile-telephones in its sector over associated antenna elements 16-1, 16-2. Converters 15 are connect to base station radios 13, and include an D/A-A/D converter and base band/RF-RF/base band converter for converting digital base band signals outputted from base station radios 13 into analog RF signals for transmission over antenna configuration 14, and vice-versa for analog RF signals received over antenna configuration 14. Each antenna element 16-1, 16-2 is connected to a converter 15 via a separate cable, wire or optical fiber, not shown, and produces a beam of approximately 120° for providing wireless communication coverage (or beam coverage) to mobile-telephones within its associated sector.

The beams produced by antenna elements 16-1, 16-2 are non-variable or fixed beamwidths and, thus, the associated sectors, in effect, are fixed in size. Fixed size sectors are undesirable because traffic distribution and loading patterns may not be uniform across each sector resulting in inefficient utilization of base station radio resources. For example, the number of mobile-telephones in one sector may exceed the capacity (or capability to process signals being transmitted to and from the mobile-telephones) of the associated set of base station radios 13, whereas the number of mobile-telephones in another sector may not exceed the capacity of the associated set of base station radios 13 resulting in unused excess capacity. Or the loading pattern at one time of day may differ from the loading pattern at another time of day due to, for example, commuter traffic resulting in inadequate base station radio resources in one sector and excess base station radio resources in another sector.

To overcome these problems associated with fixed size sectors, adaptive or variable sectorization has been proposed. Adaptive sectorization allows for sector sizes to be adjusted by varying the associated beam coverage. FIG. 2 depicts an adaptive sectorized cell 20 in accordance with the prior art. Cell 20 includes three sectors A, B, C, and has an associated base station 22 for providing wireless communication services to mobile-telephones within cell 20. FIG. 3 depicts a more detailed illustration of base station 22, which includes a set of base station radios 23 per sector, butler matrices 25, converters 21 and an antenna configuration 24. Butler matrices 25 are connected to base station radios 23 for shifting phases of digital base band signals outputted by base station radios 23 to obtain phase shifted digital base band signals. Converters 21 are connected to butler matrices 25 for converting the phase shifted digital base band signals into phase shifted analog RF signals for transmission over antenna configuration 24.

Antenna configuration 24 comprising of an antenna array 27 per butler matrix 25, wherein each antenna array 27 includes four antenna elements 26. Each antenna element 26 in antenna array 27 is connected by a separate cable, wire or optical fiber to converters 21, and produces a beam of approximately 120°. Thus, twelve cables are required for connecting the twelve antenna elements to converters 21. The 120° beams produced by antenna elements 26 of antenna array 27 are combined and manipulated via associated butler matrix 25 to produce four 30° beams over which downlink signals may be transmitted, wherein a downlink signal intended for a particular mobile-telephone is only transmitted over the 30° beam covering the area in which that mobile-telephones is currently positioned.

Each set of base station radios 23 has an associated set of 30° beams (hereinafter referred to as "beam set"). The number of 30° beams in each beam set determines the size of each sector A, B, C. Accordingly, the size of each sector A, B, C may be adjusted by varying the number of 30° beams in the associated beam set. Suppose each beam set initially includes four adjacent 30° beams, thus, each sector A, B, C had a size corresponding to 120°. If the traffic in sector A of cell 20 exceeds the capacity of the associated set of base station radios, sector A may be adjusted to correspond to the coverage area of three adjacent 30° beams to reduce the load of sector A, and either sector B or C may be adjusted to correspond to the coverage area of five adjacent 30° beams to increase its load if there exist unused base station radio resources in that sector.

The architecture of cell 20, however, would not be easy to implement in wireless communication systems based on Code Division Multiple Access (CDMA) techniques because a pilot signal is required to be transmitted along with other downlink signals such that coherent demodulation of downlink signals can be performed at the mobile-telephones. If only one antenna element 26 in antenna array 27 is used to transmit the pilot signal, the pilot signal will be transmitted over a 120° beam formed by that antenna element 26 and, thus, a phase difference may exist between the pilot signal and downlink signals transmitted over the 30° beams making it difficult to coherently demodulate such downlink signals using the pilot signal. Alternately, if a pilot signal is transmitted over every antenna element 26 in antenna array 27, the pilot signal will only be transmitted over a resulting 30° beam formed by all the antenna elements 26 through butler matrix 25 and, thus, the pilot signal cannot be used to demodulate downlink signals transmitted over other 30° beams. Accordingly, there exists a need for an adaptive sectorization technique that would amiable to CDMA environments.

SUMMARY OF THE INVENTION

The present invention is an adaptive sectorization technique that is amiable to CDMA environments using an antenna configuration and a phase shifter network that can form a variable width beam over which a pilot signal and other downlink signals may be transmitted. The antenna configuration having at least an antenna sub-array with two or more antenna elements. The phase shifter network having a plurality of switches for adjusting beam width by directing signals to be transmitted over one or more of the antenna elements, and phase shifters for shifting phases of the signals to be transmitted over the one or more antenna elements. In one embodiment, the phase shifter network is at the RF front end allowing for phase adjustment at the RF front end instead of at digital base band signal processing. Adjusting the phases at the RF front end enables transmission of the pilot signal and downlink signals in a same beam pattern generated by one of the antenna sub-arrays in the antenna configuration, thereby eliminating pilot error resulting when the pilot signal and downlink signals are transmitted over different beams.

BRIEF DESCRIPTION OF THE DRAWINGS

The features, aspects, and advantages of the present invention will become better understood with regard to the following description, appended claims, and accompanying drawings where:

DETAILED DESCRIPTION

Figure 1:
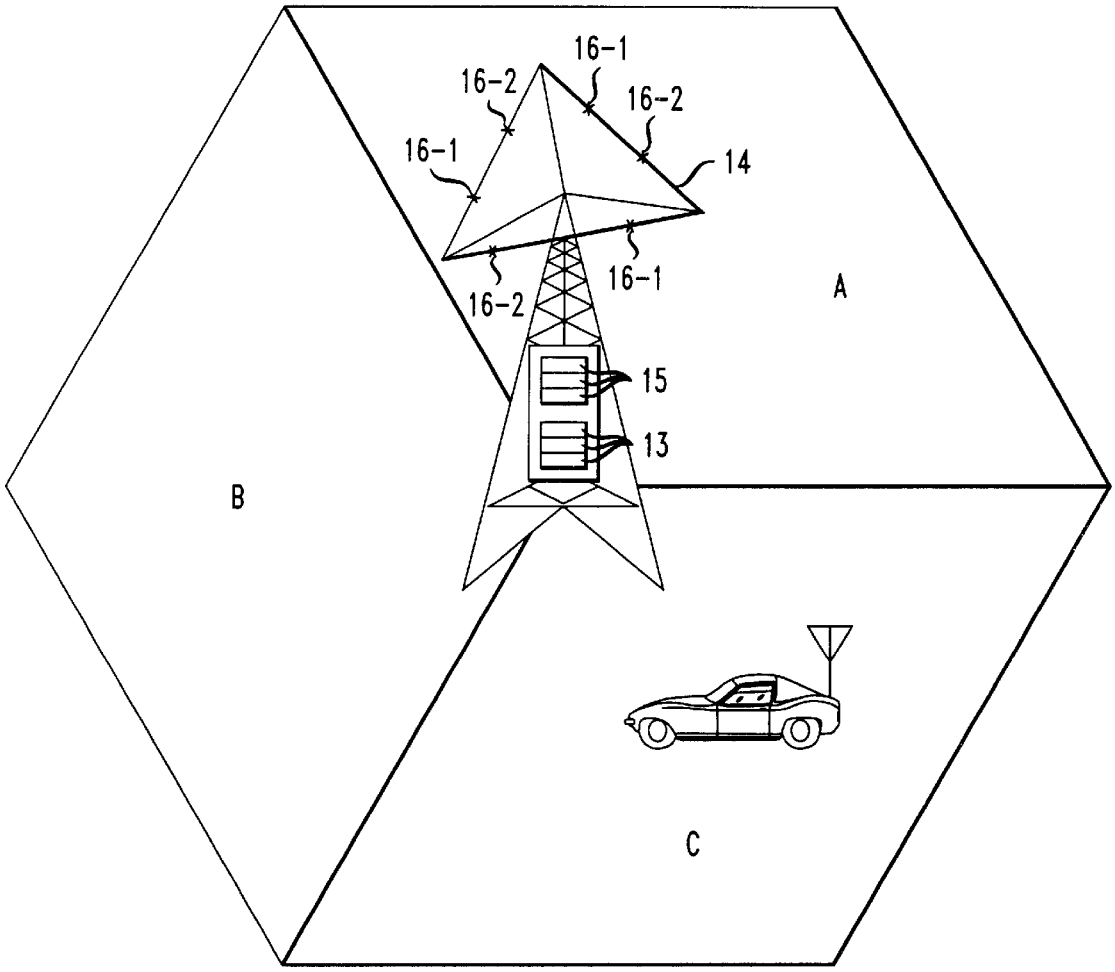
FIG. 1 PRIOR ART
FIG. 1 depicts a conventional sectorized cell in accordance with the prior art.
Figure 2:
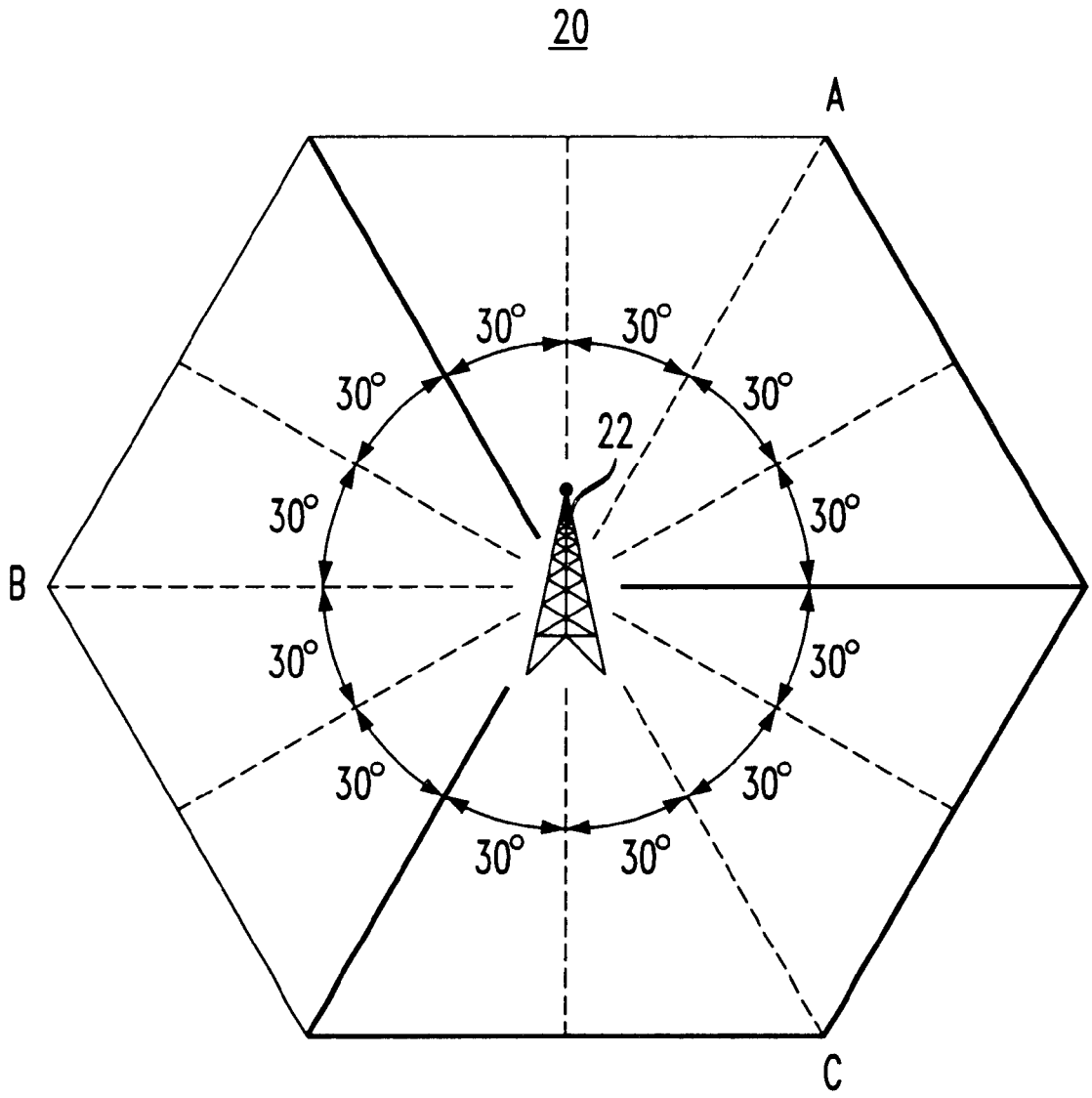
FIG. 2 PRIOR ART
FIG. 2 depicts an adaptive sectorized cell in accordance with the prior art.
Figure 3:
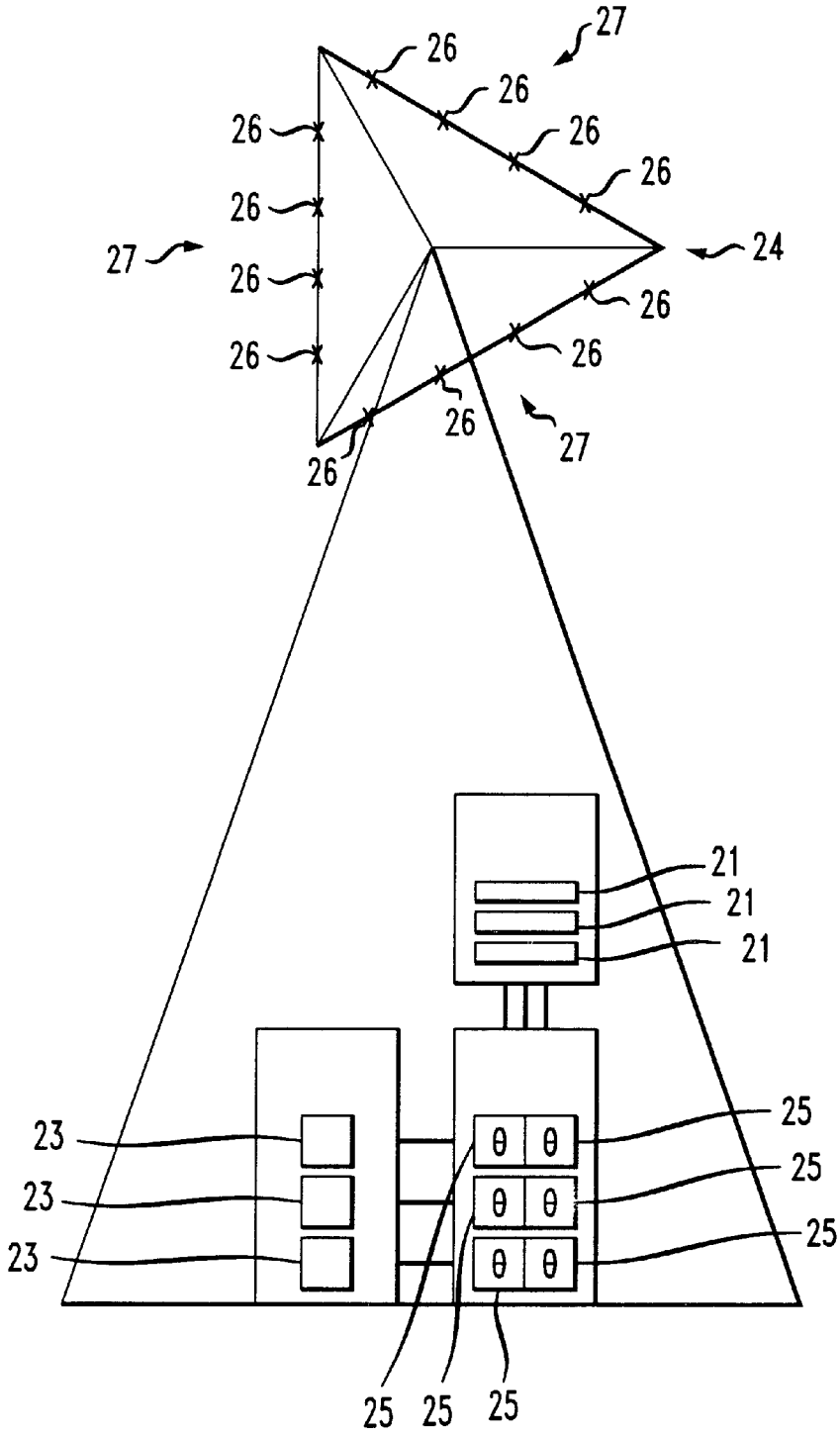
FIG. 3 PRIOR ART
FIG. 3 depicts a more detailed illustration of the base station shown in FIG. 2.
Figure 4:
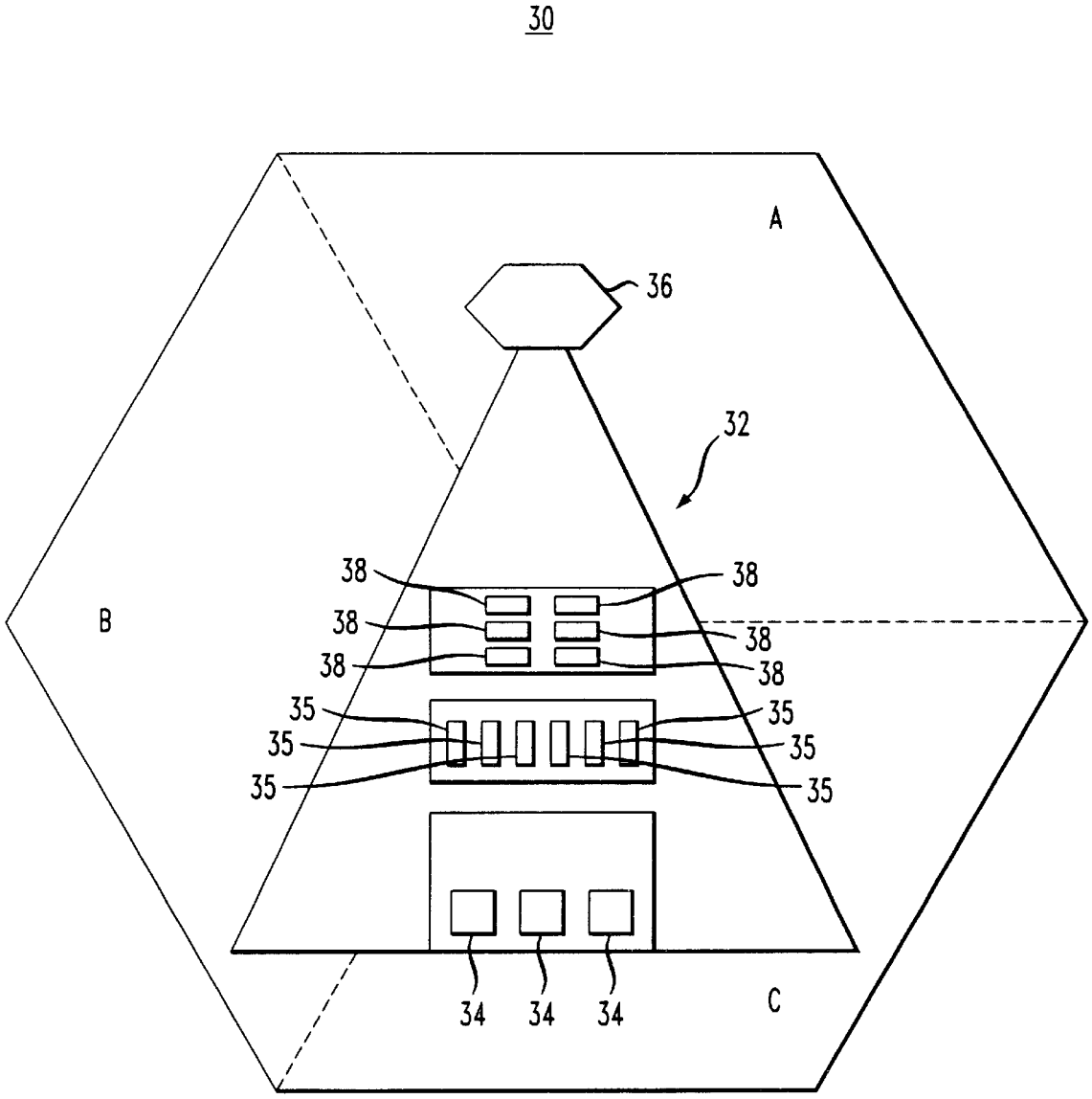
FIG. 4 depicts an adaptive sectorized cell used in accordance with the present invention.

The present invention is an adaptive sectorization technique employing an antenna configuration and phase shifter network for control of beamwidth and beam pointing direction. FIG. 4 depicts an adaptive sectorized cell 30 used in accordance with the present invention. Cell 30 includes three variable size sectors A, B, C, and has an associated base station 32 for providing wireless communication services to mobile-telephones within cell 30. Base station 32 includes, per sector, a set of base station radios 34, an antenna configuration 36 comprising of a plurality of antenna sub-arrays, a phase shifter network 38 per antenna sub-array, and a converter 35 per antenna sub-array, wherein base station radios and converters 35 are typically mounted at the base of base station 32 and antenna configuration 36 and phase shifter networks 38 are typically mounted at the top of base station 32.

Base station radios 34 are operable to perform digital base band signal processing and output digital base band signals. Converters 35 are connected to base station radios 34, and comprises D/A-A/D converters and base band/RF-RF/base band converters for converting the digital base band signals into analog RF signals and vice-versa. Each phase shifter network 38 is connected by a separate cable, wire or optical fiber, not shown, to a different converter 35 for receiving the analog RF signals. Each phase shifter network 38 comprises a plurality of switches for directing the analog RF signals to one or more antenna elements in an antenna sub-array and a plurality of phase shifters for shifting phases of the analog RF signals for purposes of controlling beamwidth and beam directions as will be described later herein.

Figure 5:
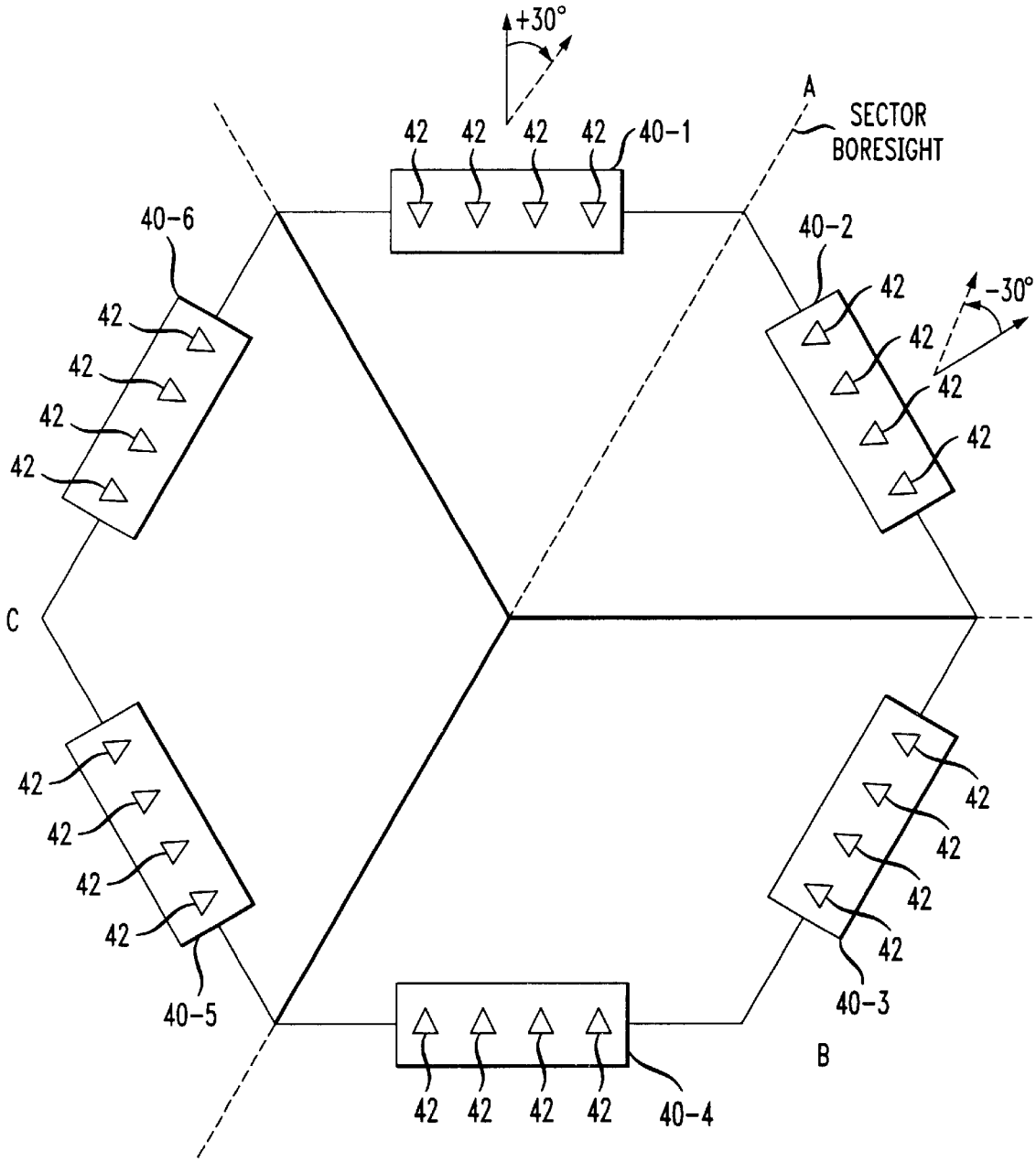
FIG. 5 depicts an antenna configuration used in accordance with one embodiment of the present invention for a three sector cell.

Each antenna sub-array of antenna configuration 36 is connected to a different phase shifter network 38, and comprises a plurality of antenna elements over which a pilot signal and other downlink signals are transmitted. FIG. 5 depicts antenna configuration 36 used in accordance with one embodiment of the present invention for a three sector cell. Antenna configuration 36 comprises six antenna sub-arrays 40, i.e., two antenna sub-arrays per sector. Each antenna sub-array 40 is connected to a separate phase shifter network 38, and comprises four antenna elements 42-1, 42-2, 42-3 and 42-4, wherein each antenna element 42 produces beams of approximately 180°. Inter-antenna element spacing between antenna elements 42-1 and 42-2 being a distance $D_{1-2}$, between antenna elements 42-2 and 42-3 being a distance $D_{2-3}$, and between antenna elements 42-3 and 42-4 being a distance $D_{3-4}$. The distances between antenna elements would depend upon desired beamwidths, as will be described herein. Additionally, antenna elements 42-1, 42-2, 42-3 and 42-4 may be mounted in a fixed or moveable manner such that distances between antenna elements may be fixed or variable.

Antenna sub-arrays 40 are mounted on a horizontal plane and in a hexagonal arrangement. In the hexagonal arrangement, there are two antenna sub-arrays 40 per sector with a 60° offset between any two antenna sub-arrays 40 belonging to a same sector. A nominal center line of the sector or nominal sector boresight is offset 30° from either sub-array. The pointing direction of an entire sector can be scanned 30° in either direction about its center line via phase shifter network 38 without requiring either of its associated antenna sub-arrays 40 to scan more than 60° off its broadside. If the pointing direction of the entire sector needs to be scanned more than 30° off its center line, then one or both antenna sub-arrays associated with or serving the sector may be changed.

Figure 6:
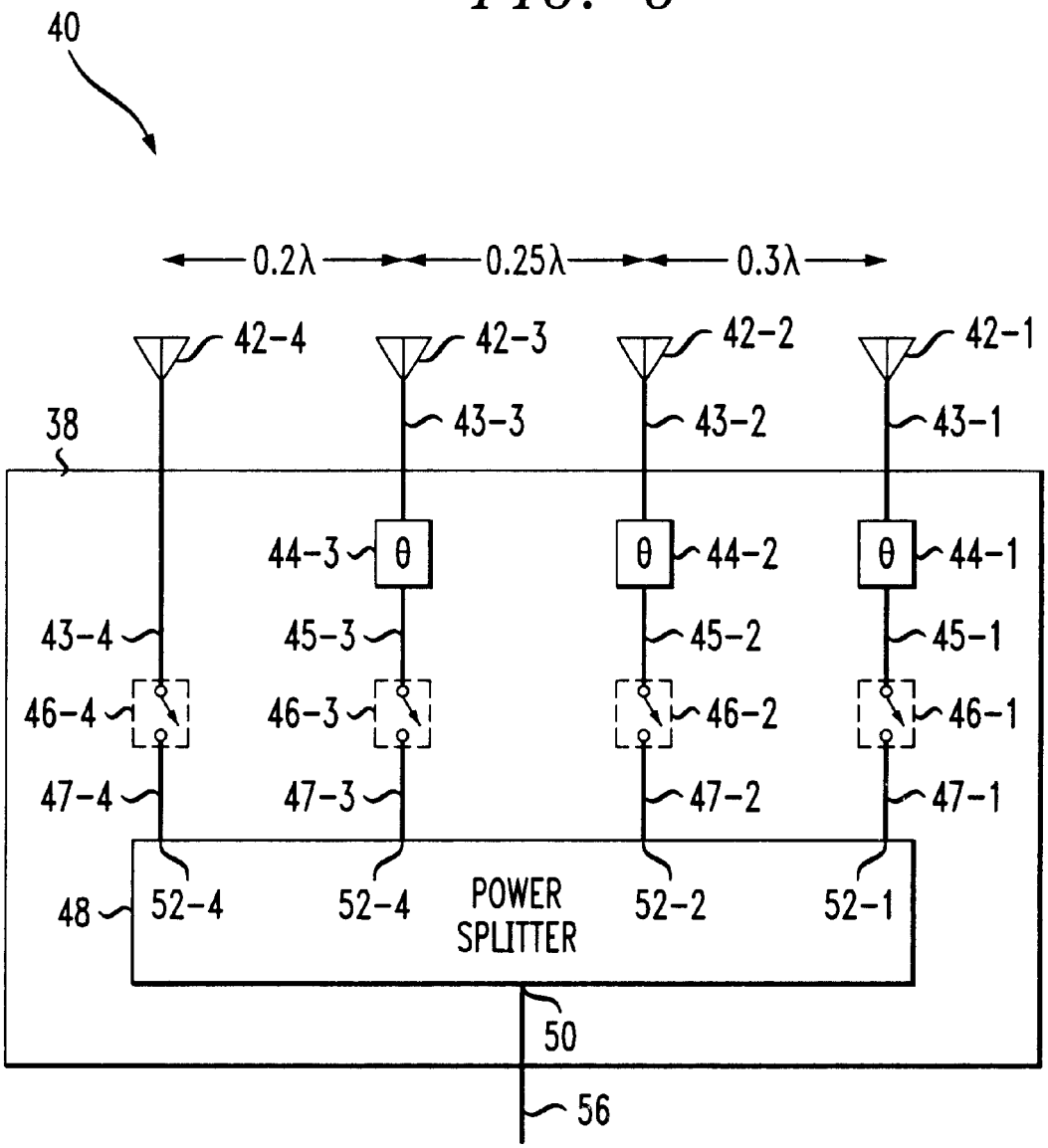
FIG. 6 depicts a phase shifter network in conjunction with an antenna sub-array in accordance with one embodiment of the present invention.

As mentioned earlier, each phase shifter network 38 comprises a plurality of switches and phase shifters for controlling beam width and beam direction. FIG. 6 depicts phase shifter network 38 in conjunction with antenna sub-array 40 in accordance with one embodiment of the present invention. Phase shifter network 38 includes a plurality of phase shifters 44-1, 44-2 and 44-3, a plurality of switches 46-1, 46-2, 46-3 and 46-4 and a power splitter 48. shifters 44-1, 44-2 and 44-3 being operable to shift signal phases θ, where $0° \leqq \theta \leqq 360°$ switches 46-1, 46-2, 46-3 and 46-4 having a first and second position, wherein the first and second positions correspond to on and off positions for completing or discontinuing a circuit between power splitter 48 and antenna elements 42-1, 42-2, 42-3 and 42-4. Power splitter 48 being operable to split/combine signals, and having an input/output 50 and four outputs/inputs 52-1, 52-2, 52-3 and 52-4.

Switches 46-1, 46-2 and 46-3 are connected to phase shifters 44-1, 44-2 and 44-3 by couplers 45-1, 45-2 and 45-3, respectively. Phase shifters 44-1, 44-2 and 44-3 a 46-4 are connected to antenna elements 42-1, 42-2, 42-3 and 42-4 by couplers 43-1, 43-3 and 43-4, respectively. Alternately, switch 46-4 may be connected to antenna element 42-4 via a phase shifter. Outputs/inputs 52-1, 52-2, 52-3 and 52-4 of power splitter 48 are connected to switches 46-1, 46-2, 46-3 and 46-4. by couplers 47-1, 47-2, 47-3 and 47-4, respective Input/output 50 (or phase shifter network 38) is connected to converter 35 by cable 56.

The present invention allows for adaptive sectorization by controlling beamwidth and beam pointing direction via the antenna configuration 36 and phase shifter network 38. Specifically, beamwidth is controlled by switching antenna elements 42-1, 42-2, 42-3 and 42-4 on and off using switches 46-1, 46-2, 46-3 and 46-4, by the spacing between antenna elements, and by the number of antenna elements per sub-array 60. Beam pointing direction is controlled using phase shifters 44-1, 44-2 and 44-3, as is well known in the art.

In an embodiment of the present invention, inter-antenna element spacing between antenna elements 42-1, 42-2, 42-3 and 42-4 are 0.3λ, 0.25λ and 0.2λ, as shown in 6, where λ corresponds to a carrier frequency of signals to be transmitted over the antenna elements. A variety of different half power beamwidths (HPBW) may formed using this inter-antenna element spacing configuration. Table 1 shows six possible sets A–F of switch settings for achieving different HPBW which, in effect, causes sector size to change. For example, for switch setting A, when antenna elements 42-1 and 42-2 are turned off via switches 46-1 and 46-2 and antenna elements 42-3 and 42-4 are turned on via switches 46-3 and 46-4, an 150° HPBW is formed by an antenna sub-array, which is used for nominal sector size of 180°. For switch setting E, when antenna elements 42-4 is turned off via switch 46-4 and antenna elements 42-1, 42-2 and 42-3 are turned on via switches 46-1, 46-2 and 46-3, an 70° HPBW is formed. Note that each antenna element is assumed perfect beam pattern from 0° to 180° with an unity antenna gain between 0° to 180° and zero otherwise.

TABLE 1

| Switch Settings | Nominal Sector Size | −3 dB Beamwidth | Antenna Element Setting 42-1 | 42-2 | 42-3 | 42-4 |
|---|---|---|---|---|---|---|
| A | 180° | 150° HPBW | OFF | OFF | ON | ON |
| B | 180° | 150° HPBW | OFF | ON | ON | OFF |
| C | 120° | 112° HPBW | ON | ON | OFF | OFF |
| D | 100° | 88° HPBW | OFF | ON | ON | ON |
| E | 80° | 70° HPBW | ON | ON | ON | OFF |
| F | 60° | 54° HPBW | ON | ON | ON | ON |

Figure 7:
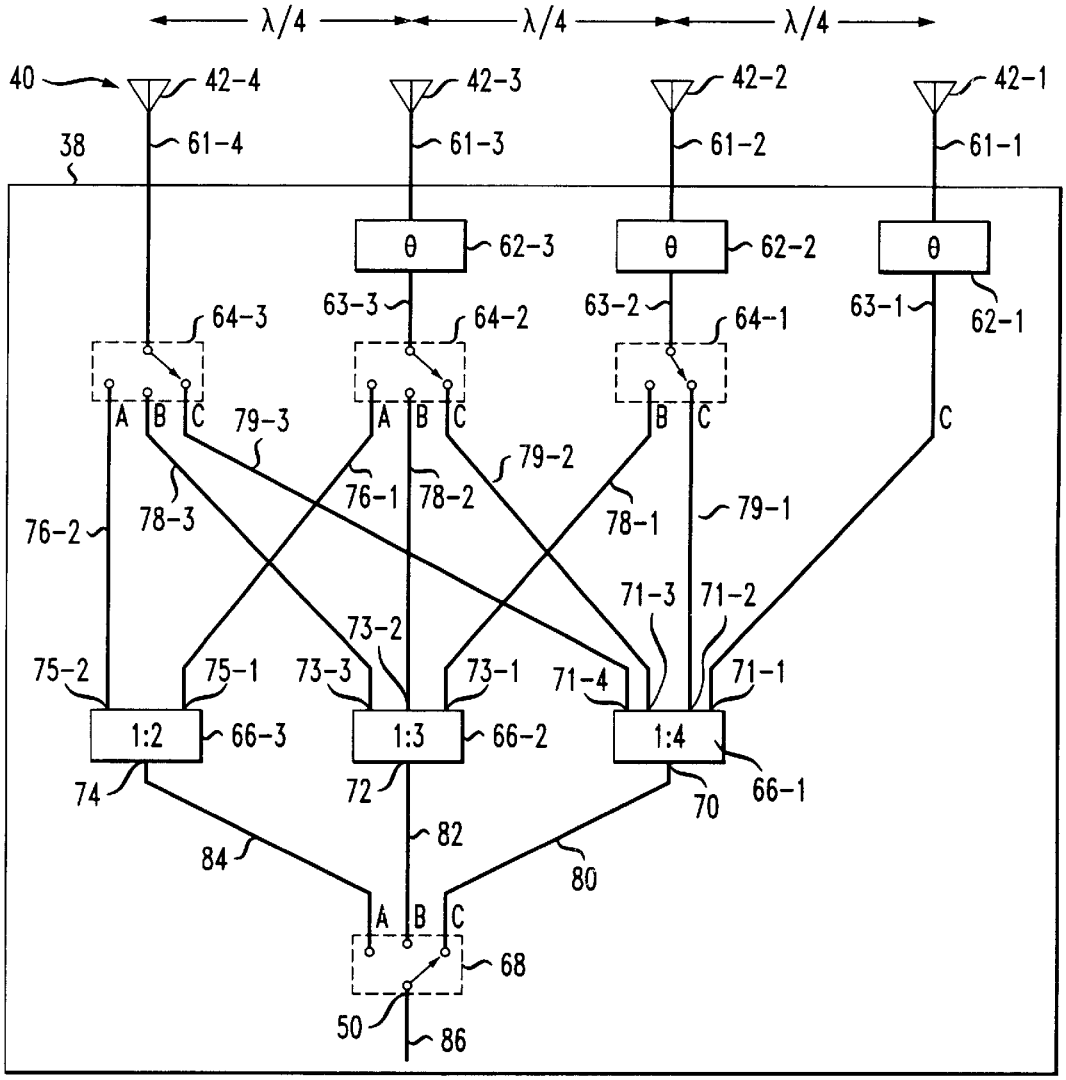
FIG. 7 depicts a phase shifter network in conjunction with an antenna sub-array in accordance with another embodiment of the present invention.

FIG. 7 depicts phase shifter network 60 in conjunction with antenna sub-array 40 in accordance with another embodiment of the present invention. In this embodiment, inter-antenna element spacing is 0.25λ. Phase shifter network 60 includes a plurality of phase shifters 62-1, 62-2 and 62-3, a plurality of switches 64-1, 64-2, 64-3 and 68, and a plurality of power splitters 66-1, 66-2 and 66-3. Phase shifters 62-1, 62-2 and 62-3 being operable to shift signal phases θ, where $0° \leqq \theta \leqq 360°$. Switch 64-1 having positions B and C, and switches 64-2, 64-3 and 68 having positions A, B and C. Power splitters 66-1, 66-2 and 66-3 being operable to split/combine signals. Power splitter 66-1 having an input/output 70 and four outputs/inputs 71-1, 71-2, 71-3 and 71-4. Power splitter 66-2 having an input/output 72 and three outputs/inputs 73-1, 73-2 and 73-3. Power splitter 66-3 having an input/output 74 and two outputs/inputs 75-1 and 75-2.

Antenna elements 42-1, 42-2, 42-3 and 42-4 are connected to phase shifters 62-1, 62-2 and 62-3 and switch 64-3 by couplers 61-1, 61-2, 61-3 and 61-4, respectively. Phase shifters 62-1, 62-2 and 62-3 are connected to output/input 71-1 of power splitter 66-1 and switches 64-1 and 64-2 by couplers 63-1, 63-2 and 63-3, respectively. Switches 64-2 and 64-3 via position A are connected to outputs/inputs 75-1 and 75-2 of power splitter 66-3 by couplers 76-1 and 76-2, respectively. Switches 64-1, 64-2 and 64-3 via position B are connected to outputs/inputs 73-1, 73-2 and 73-3 of power splitter 66-2 by couplers 78-1, 78-2 and 78-3, respectively. Switches 64-1, 64-2 and 64-3 via position C are connected to outputs/inputs 71-2, 71-3 and 71-4 of power splitter 66-1 by couplers 79-1, 79-2 and 79-3, respectively. Inputs/outputs 70, 72 and 74 are connected to switch 68 via positions C, B and A by couplers 80, 82 and 84, respectively. Input/output 50 (or phase shifter network 38) is connected to converter 35 by cable 86.

Table 2 shows three possible sets A–C of switch settings for achieving different HPBW which, in effect, causes sector size to change. It should be noted that, for table 2, switch setting A corresponds to switches 68, 64-2 and 64-3 being in position A, and switch setting B and C correspond to switches 68, 64-1, 64-2 and 64-3 being in positions B and C, respectively. For example, for switch setting A (i.e., switches 64-2, 64-3 and 68 are in position A), when antenna elements 42-1 and 42-2 are turned off and antenna elements 42-3 and 42-4 are turned on, an 150° HPBW is formed. Note that each antenna element is assumed perfect beam pattern from 0° to 180° with an unity antenna gain between 0° to 180° and zero otherwise.

TABLE 2

| Switch Settings | Nominal Sector Size | −3 dB Beamwidth | Antenna Element Setting 42-1 | 42-2 | 42-3 | 42-4 |
|---|---|---|---|---|---|---|
| A | 180° | 150° HPBW | OFF | OFF | ON | ON |
| B | 90° | 90° HPBW | OFF | ON | ON | ON |
| C | 60° | 60° HPBW | ON | ON | ON | ON |

In operation, pilot signals and other downlink signals to be transmitted by base station 32 to mobile-telephones undergo digital base band signal processing at base station radios 34 associated with the sectors in which the mobile-telephones are currently positioned. The outputs of base station radios 34, i.e., digital base band signals, are converted into analog RF signals by converters 35. The analog RF signals are then inputted into phase shifter networks 38 associated with the sub-arrays 40 or beams over which the pilot signals and other downlink signals are to be transmitted. The analog RF signals are phase shifted and directed to one or more antenna elements belonging to the associated antenna sub-arrays 40 in antenna configuration 36 for transmission. The amount of phase shifting and the particular antenna elements to which the analog RF signals are directed being dependent on a desired beam direction and sector or beam width, respectively.

For example, suppose a mobile-telephone is currently positioned in sector A. Base station radio 34 associated with sector A performs the digital base band signal processing of the pilot signal and other downlink signals intended for that mobile-telephone. The digital base band signal output by base station radio 34 is converted by an associated converter 35 into an analog RF signal and then provided as input to a phase shifter network 38 associated with sector A. The analog RF signal is phase shifted and directed to one or more antenna elements belonging to a sub-array 40 associated with sector A for transmission of both the pilot signal and other downlink signals over a single resulting beam formed by the antenna elements.

The present invention can be applied in CDMA wireless communication systems based on the well-known IS-95 standard and in third generation CDMA wireless systems. In one embodiment, the pilot signal and other downlink signals are only transmitted over one of the sub-arrays associated with each sector. In other words, the pilot signal and other downlink signals will only be transmitted over one beam per sector. This embodiment would most likely be used in CDMA wireless communication systems based on the IS-95 standard in which only one sub-array associated with a sector is used to transmit downlink signals.

In another embodiment, the pilot signal and other downlink signals may transmitted over one of the sub-arrays associated with each sector, and an auxiliary or another pilot signal along with the another version of the other downlink signals (i.e., other downlink signals encoded with a different orthogonal code) may be transmitted over another sub-array associated with the same sector if Space Time Spreading (STS) transmit diversity technology is implemented. In other words, different versions of the pilot signal and other downlink signals are transmitted over separate beams in a same sector. This embodiment would most likely be used in third generation CDMA wireless communication systems in which two sub-arrays associated with a sector are used to transmit downlink signals.

The present invention is described herein with reference to certain embodiments. It should be understood that the present invention is also applicable to other embodiments. For example, the present invention antenna configuration may be modified for cells having a different number of sectors (e.g., eight antenna arrays for a four sector cell), a different number of antenna elements per sector, or antenna elements producing different size beams (e.g., 120° beams). The antenna elements may be mounted in a non-hexagonal arrangement with different offsets and scanning angles on a vertical plane, or each antenna array may include two or more sets of antenna elements mounted on different horizontal planes. Additionally, it should be understood that the present invention is applicable to wireless communication systems employing multiple access techniques other than code division multiple access. Accordingly, the present invention should not be limited to the embodiments disclosed herein.

We claim:

1. A base station for providing wireless communication services to wireless communication devices located within an associated cell having sectors, the base station comprising:

an antenna configuration having at least an antenna sub-array with two or more antenna elements;

a set of base station radios for processing signals to be transmitted over one or more antenna elements into digital base band signals;

a converter for converting the digital base band signals into analog radio frequency signals; and a phase shifter network for directing the analog radio frequency signals to be transmitted over one or more of the antenna elements and for shifting phases of the analog radio frequency signals to be transmitted over the one or more antenna elements, wherein the phase shifter network includes a plurality of switches for directing the signals to be transmitted to one or more of the antenna elements.

2. The base station of claim 1, wherein antenna elements of an antenna sub-array are mounted on a horizontal plane.

3. The base station of claim 1, wherein the antenna sub-array comprises of a first set of antenna elements mounted on a horizontal plane and a second set of antenna elements mounted on a different horizontal plane.

4. The base station of claim 1, wherein the antenna configuration has two antenna sub-arrays for each of the sectors.

5. The base station of claim 4, wherein the cell has three sectors and the antenna sub-arrays are arranged in a hexagonal arrangement.

6. The base station of claim 1, wherein each of the antenna sub-arrays comprises a first, second, third and fourth antenna element.

7. The base station of claim 6, wherein the antenna elements in the antenna sub-array are spaced apart from each other approximately one quarter of a wavelength of a carrier frequency of the signals to be transmitted.

8. The base station of claim 7, wherein the phase shifter network directs the signals to be transmitted to the first and second antenna elements but not to the third and fourth antenna elements, the first and second antenna elements. being adjacent to each other and the third and fourth antenna elements being adjacent to each other.

9. The base station of claim 7, wherein the phase shifter network directs the signals to be transmitted to the first, second and third antenna elements but not to the fourth antenna element, the first and third antenna elements being adjacent to the second antenna element.

10. The base station of claim 7, wherein the phase shifter network directs the signals to be transmitted to the first, second, third and fourth antenna elements.

11. The base station of claim 6, wherein inter-antenna element spacing between the first and the second antenna element is approximately two tenths of a wavelength of a frequency of the signals to be transmitted, inter-antenna element spacing between the second antenna element and the third antenna element is approximately one quarter of the wavelength of the frequency of the signals to be transmitted, and inter-antenna element spacing between the third antenna element and the fourth antenna element is approximately three tenths of the wavelength of the frequency of the signals to be transmitted.

12. The base station of claim 11, wherein the phase shifter network directs the signals to be transmitted to the first and second antenna elements but not to the third and fourth antenna elements, the first and second antenna elements being adjacent to each other and the third and fourth antenna elements being adjacent to each other.

13. The base station of claim 11, wherein the phase shifter network directs the signals to be transmitted to the first, second and third antenna elements but not to the fourth antenna element, the first and third antenna elements being adjacent to the second antenna element.

14. The base station of claim 11, wherein the phase shifter network directs the signals to be transmitted to all four antenna elements.

15. The base station of claim 11, wherein the phase shifter network directs the signals to be transmitted to the first and second antenna elements but not to the third and fourth antenna elements, the first and second antenna elements being adjacent to each other and the third and fourth antenna elements being non-adjacent to each other.

16. The base station of claim 1, wherein the phase shifter network comprises:

a plurality of phase shifters for shifting phases of the signals to be transmitted over the one or more antenna elements.

17. The base station of claim 16, wherein each antenna element has an associated switch.

18. The base station of claim 16, wherein all or one less than all of the antenna elements have an associated phase shifter.

19. The base station of claim 16, wherein the phase shifter network further comprises:

a plurality of power splitters for splitting signals to be transmitted.

20. The base station of claim 1, wherein each antenna element is operable in the antenna sub-array to form a beam of approximately 180°.

21. The base station of claim 1, wherein spacing between the or more two antenna elements of the antenna sub-array is a distance up to one half wavelength of a carrier frequency of the signals to be transmitted.

22. The base station of claim 21, wherein the two or more antenna elements are mounted in fixed positions.

23. The base station of claim 21, wherein at least one of the antenna elements is mounted in a moveable position such that the distance between the two or more antenna elements are a variable distance.

24. The base station of claim 1, wherein a pilot signal and other downlink signals are transmitted over at least one antenna sub-array.

25. The base station of claim 1, wherein a pilot signal and other downlink signals are transmitted over two antenna sub-arrays associated with a same sector using space time spreading techniques.

26. A base station for providing wireless communication services to wireless communication devices located within an associated cell having sectors, the base station comprising:

an antenna configuration having at least an antenna sub-array with two or more antenna elements;

a set of base station radios for processing signals to be transmitted over one or more antenna elements into digital base band signals;

a converter for converting the digital base band signals into analog radio frequency signals; and a phase shifter network for directing the analog radio frequency signals to be transmitted over one or more of the antenna elements and for shifting phases of the analog radio frequency signals to be transmitted over the one or more antenna elements, wherein at least one of the antenna elements is mounted in a moveable position such that the distance between the two or more antenna elements are a variable distance.

* * * * *